US005464118A

United States Patent [19]

Grau et al.

[11] Patent Number: 5,464,118

[45] Date of Patent: Nov. 7, 1995

[54] APPARATUS FOR REMOVING SOLID MEDICATIONS FROM BLISTER PACKS

[75] Inventors: Ulrich Grau, Eschborn; Günter Ziegert, Frankfurt am Main, both of Germany

[73] Assignee: Hoechst Aktiengesellschaft, Frankfurt am Main, Germany

[21] Appl. No.: 287,601

[22] Filed: Aug. 9, 1994

[30] Foreign Application Priority Data

Aug. 11, 1993 [DE] Germany ..... 43 26 931.1

[51] Int. Cl.[6] ..... B65D 83/04

[52] U.S. Cl. ..... 221/5; 221/31; 221/88; 206/531; 206/534

[58] Field of Search ..... 221/5, 30–32, 221/79, 81, 88; 206/531, 534

[56] References Cited

U.S. PATENT DOCUMENTS

| | | | |
|---|---|---|---|
| 3,279,651 | 10/1966 | Thompson | 206/531 |
| 3,651,927 | 3/1972 | Richardson et al. | 221/5 |
| 4,015,717 | 4/1977 | Richardson et al. . | |
| 4,298,125 | 11/1981 | Berghahn et al. | 206/531 |
| 4,778,054 | 10/1988 | Newell et al. | 206/531 |
| 5,336,213 | 8/1994 | D'Angelo et al. | 206/531 |
| 5,348,158 | 9/1994 | Honan et al. | 206/531 |

FOREIGN PATENT DOCUMENTS

| | | | |
|---|---|---|---|
| 315951 | 5/1989 | European Pat. Off. . | |
| 801954 | 5/1936 | France | 221/88 |
| 2321615 | 11/1974 | Germany . | |
| 3922763 | 1/1991 | Germany | 206/531 |

*Primary Examiner*—H. Grant Skaggs

*Attorney, Agent, or Firm*—Finnegan, Henderson, Farabow, Garrett & Dunner

[57] ABSTRACT

In the apparatus for removing solid medications from blister packs, comprising a shell-shaped bottom part and a hood-shaped top part, the bottom part (2) is provided with an axle (13). It further exhibits recesses (10), which are disposed concentrically to the axle (13). The one end of the axle (13) is configured as a rotational axis and translational guide for the top part (1). The top part (1) reaches over the bottom part (2) and exhibits a hub (15), which is supported on the axle (13) by means of a spring (6). Parallel to the hub (15) on the top part (1) there is disposed a ram (8), which, given an appropriate setting of the top part (1) relative to the bottom part (2), is aligned with respectively one of the recesses (10). The other end of the axle (13) is provided with a journal (11) for receiving a bearing plate (7) for the blister pack (5). The bearing plate (7) exhibits holes (9), which form with the recesses (10) of the bottom part (2) passages for the ram (8).

4 Claims, 2 Drawing Sheets

Fig. 2
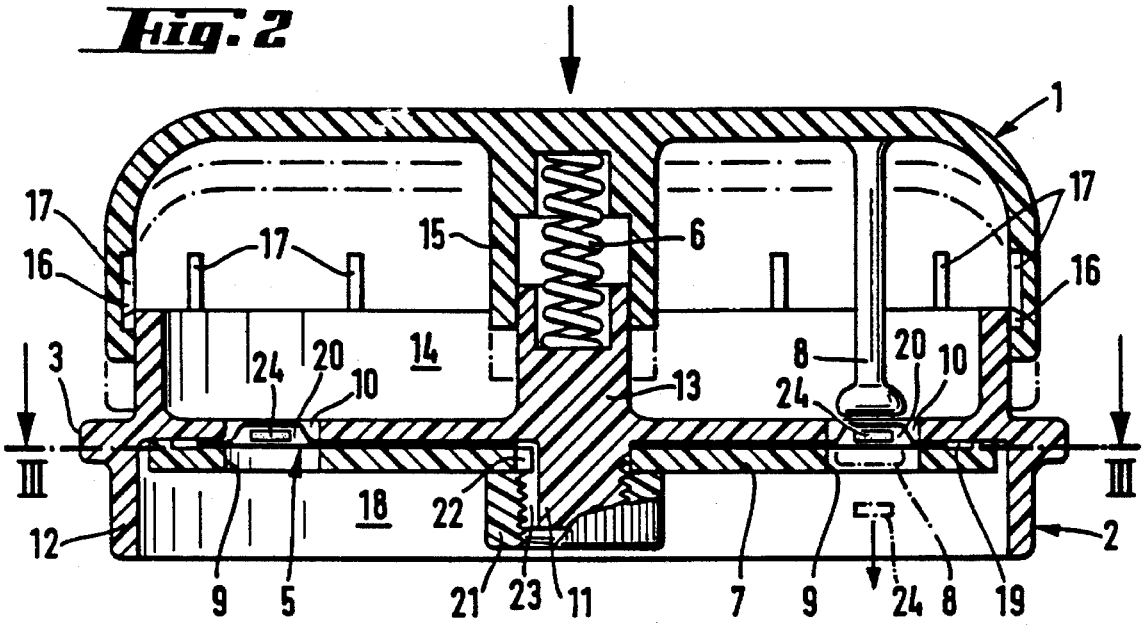
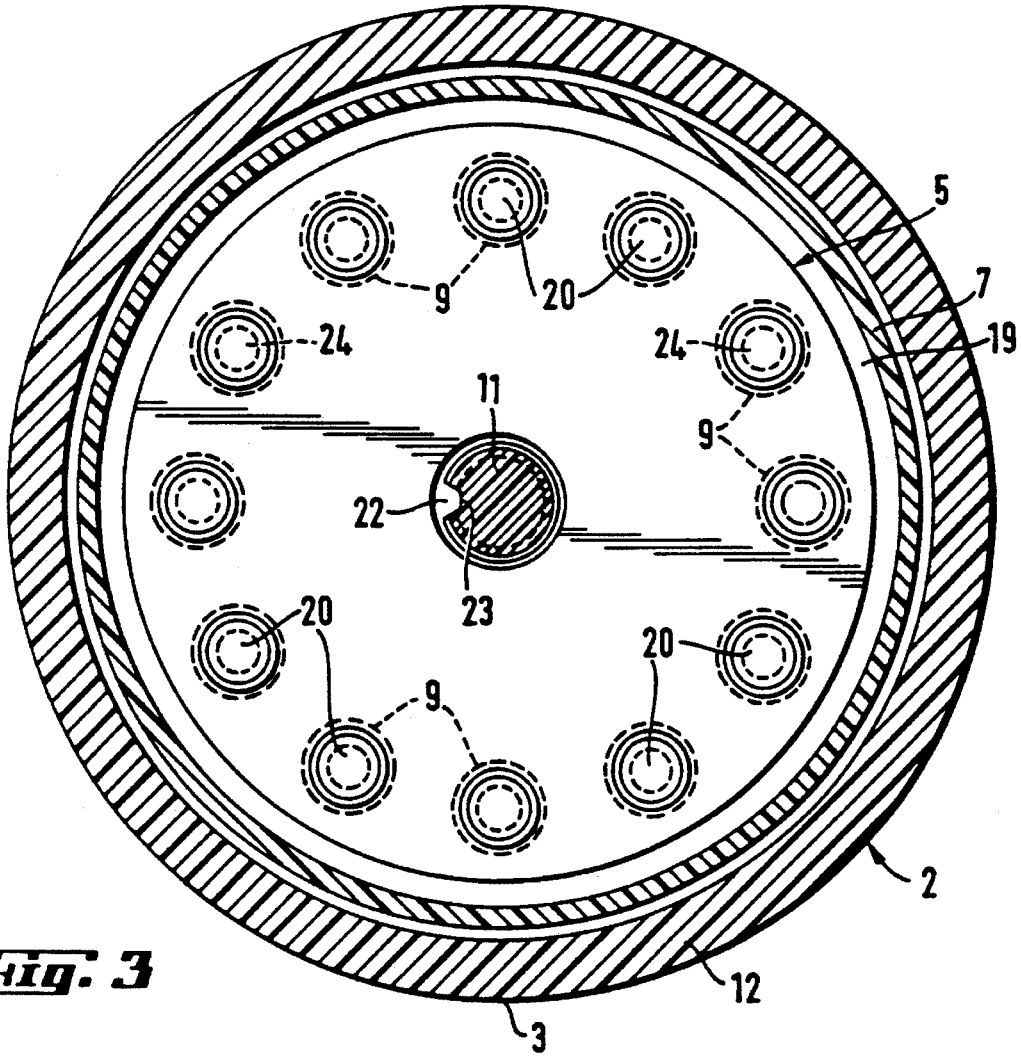
Fig. 3

APPARATUS FOR REMOVING SOLID MEDICATIONS FROM BLISTER PACKS

The invention relates to an apparatus for removing solid medications from blister packs, comprising a shell-shaped bottom part and a hood-shaped top part.

Apparatuses of the said type are known from EP-A-0 315 951. The strip-shaped blister inserted between the shell-shaped bottom part and the hood-shaped top part is emptied by means of a slide, which is displaceable in increments along the blister and exhibits a ram. For weak patients, especially those restricted in their movement, this apparatus is too complicated. The apparatus, moreover, is not child-proof.

The invention aims to remedy this.

The invention achieves the object by the fact that the bottom part is provided with an axle and exhibits recesses, which are disposed concentrically to the axle, the one end of the axle is configured as a rotational axis and translational guide for the top part, the top part reaches over the bottom part and exhibits a hub, which is supported on the axle by means of a spring, parallel to the hub on the top part there is disposed a ram which, given an appropriate setting of the top part relative to the bottom part, is aligned with respectively one of the recesses, the other end of the axle is provided with a journal for receiving a bearing plate for the blister pack, and the bearing plate exhibits holes, which form with the recesses of the bottom part a passage for the ram.

The bottom part can be provided with a base ring, on which there are disposed markings for the passages, and the top part exhibits an indicator for the position of the ram. The bottom and top parts can be provided with devices for the incremental progression of the ram from passage to passage.

The advantages of the apparatus can essentially be seen in the fact that the medication is hermetically enclosed, the ram is positioned by incremental rotation of the top part over the passages and hence over the medication to be removed and can be slid easily into the passage, whereupon the medication is forced out of the pack. The apparatus is child-proof.

The apparatus is explained in greater detail below with reference to drawings representing just one embodiment, in which drawings:

FIG. 2 shows the apparatus, with blister inserted, in cut representation and FIG. 3 shows the section III—III of FIG. 2.

Figure 1:
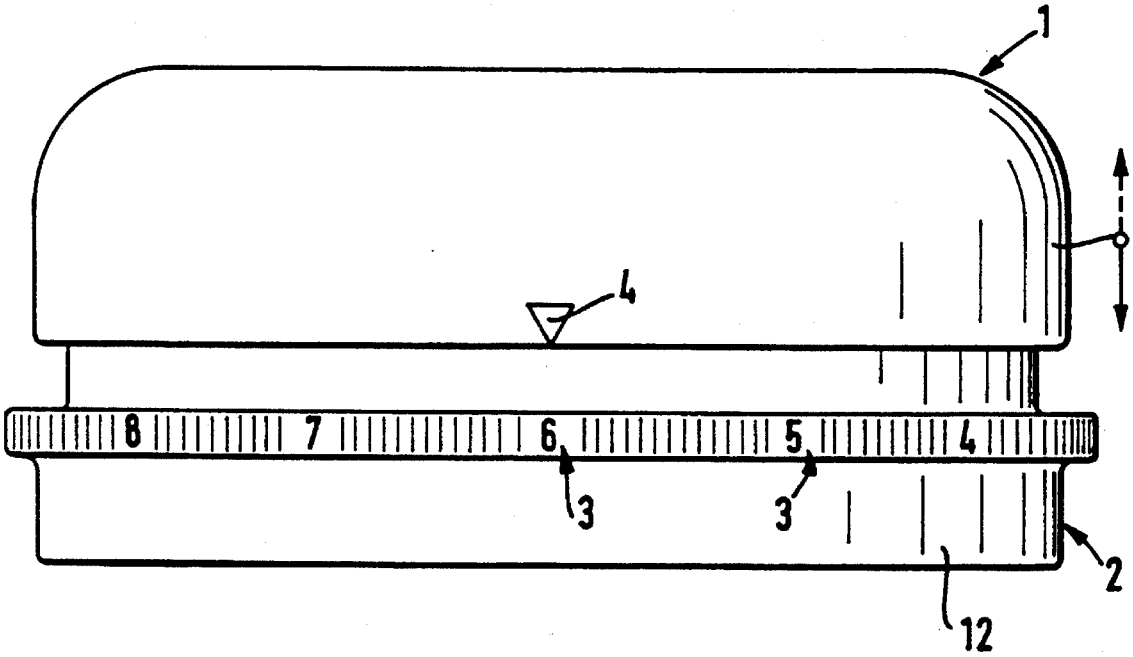
FIG. 1 shows a view of the apparatus.

The apparatus essentially comprises the shell-shaped bottom part 2 and the hood-shaped top part 1. The bottom part 2 can be provided with a base ring 12, on which there are disposed markings 3. Using the indicator 4 on the top part 1, the position of the ram 8 (FIG. 2) is defined in relation to one of the markings 3. The bottom part 2 is provided with an axle 13, which juts into the shell space 14 of the bottom part 2. Disposed concentrically to the axle 13, the bottom part 2 exhibits recesses 10. The axle 13 is configured both as a rotational axis and as a translational guide for the top part 1. The top part 1 exhibits a hub 15, which is supported on the axle 13 by means of a spring 6. Parallel to the hub 15 on the top part 1 there is disposed a ram 8, which, given an appropriate setting of the top part 1 relative to the bottom part 2, is aligned with respectively one of the recesses 10 and hence, when the top part 1 is pressed down, is able to plunge into one of the recesses 10. The bottom part 2 and the top part i can be provided with devices for an incremental movement relative to each other or for progression of the ram 8 from recess 10 to recess 10. Such devices can consist in ratchet teeth 16 on the bottom part 2 and corresponding engagements 17 on the top part I or vice versa. The axle 13 juts not only into the shell space 14 but also into the base space 18. It is configured in the base space 18 as a journal 11 having a thread or the like for receiving a bearing plate 7 for the blister pack 5. The bearing plate 7 is provided with holes 9, which form with the recesses 10 of the bottom part 2 a passage for the ram 8. Between the bearing plate 7 and the bottom part 2 there is provided a space 19 for the blister pack 5 having the medication pockets 20. The medication pockets 20 are disposed in the blister pack 5 in such a way that, when the blister pack is inserted, they jut into the recesses 10 of the bottom part 2. The bearing plate 7 can be fixed by means of a nut 21 or the like. In order to ensure that the holes 9 of the bearing plate 7 always form a passage with the recesses 10, the bearing plate 7 can be provided with a boss 22, which engages in a corresponding groove 23 in the journal 11. By pressing down the top part 2, the medication 24 is forced by the ram 8 out of the medication pocket 20.

We claim:

1. An apparatus for removing solid medications from blister packs, comprising a shell-shaped bottom part and a hood-shaped top part, the bottom part having an axle and including recesses, which are disposed concentrically to the axle, one end of the axle is configured as a rotational axis and translational guide for the top part, the top part extending over the bottom part and including a hub, which is supported on the axle by a spring, the top part further including a ram parallel to the hub which, given an appropriate setting of the top part relative to the bottom part, is aligned with respectively one of the recesses, the other end of the axle including a journal for receiving a bearing plate for the blister pack.

2. The apparatus as claimed in claim 1, wherein the bottom part includes a base ring, on which there are disposed markings for the passages, and the top part exhibits an indicator for the position of the ram.

3. The apparatus as claimed in one of claims 1 or 2, wherein the bottom part and the top part include devices for an incremental progression of the ram from passage to passage.

4. The apparatus as claimed in claim 1, wherein the bottom part and the bearing plate enclose a space.

* * * * *